US005284213A

United States Patent [19]

Nobileau

[11] Patent Number: 5,284,213

[45] Date of Patent: Feb. 8, 1994

[54] SUBSEA DRILLING CUTTINGS COLLECTOR AND METHOD OF DRILLING

[75] Inventor: Philippe C. Nobileau, Paris, France

[73] Assignee: ABB Vetco Gray, Inc., Houston, Tex.

[21] Appl. No.: 928,002

[22] Filed: Aug. 11, 1992

[51] Int. Cl.[5] ..... E21B 7/12; E21B 17/01

[52] U.S. Cl. ..... 175/5; 175/161; 175/209

[58] Field of Search ..... 175/7, 207, 209, 210, 175/161; 166/359, 367

[56] References Cited

U.S. PATENT DOCUMENTS 4,060,140 11/1977 Barrington ..... 175/7
4,220,207 9/1980 Allen ..... 175/7 X
5,188,180 2/1993 Jennings ..... 166/338

FOREIGN PATENT DOCUMENTS 2500250 7/1976 Fed. Rep. of Germany ..... 175/7
1341047 12/1973 United Kingdom ..... 175/7

*Primary Examiner*—David J. Bagnell
*Attorney, Agent, or Firm*—James E. Bradley

[57] ABSTRACT

A cuttings collector will collect cuttings generated while drilling through conductor pipe for the first string of casing. The cuttings collector has a riser that secures to the exterior of an outer wellhead housing. A cage surrounds the riser. Ports at the upper end of the riser allow cuttings to flow out the riser and back down into the cage. A funnel guide locates at the upper end of the riser to guide the drill bit and the lower end of the first string of the casing. The running tool for the first string of casing lands an inner wellhead housing in the outer wellhead housing and simultaneously engages the cuttings collector to retrieve it. Cuttings from the collector will be dumped from the cuttings collector near the surface. The cuttings collector telescopes from an extended to a collapsed position for storage.

40 Claims, 4 Drawing Sheets

SUBSEA DRILLING CUTTINGS COLLECTOR AND METHOD OF DRILLING

BACKGROUND OF THE INVENTION

1. Field of the Invention

This invention relates in general to subsea well drilling, and in particular to a means for collecting cuttings produced while drilling the well for a first string of casing after conductor pipe has been installed.

2. Description of the Prior Art

When drilling with a floating drilling vessel, normally a guide base will be installed on the sea floor. Then the well will be drilled or jetted to an initial depth of typically around 300 feet. Large diameter conductor pipe, normally 30 inches in diameter, will be installed in this initial portion of the well. An outer wellhead housing secures to the upper end of the conductor pipe and locates at the subsea floor on the guide base.

Then, the operator lowers a drill bit through the outer wellhead housing and drills through the conductor pipe to a depth that may be around 1,000 feet. The operator then runs a first string of casing, which is normally 20 inches in diameter. An inner or high pressure wellhead housing locates at the upper end of the 20 inch casing. The inner wellhead housing lands in the outer wellhead housing. The operator cements the 20 inch casing in place.

The operator installs a riser to the exterior of the inner wellhead housing leading to the surface. A blowout preventer stack is connected into the riser at a subsea location. The operator will then drill the well for at least two additional strings of casing.

While drilling the well for the 20 inch casing, there normally will be no riser to the surface because the riser will connect to the inner wellhead housing, which has not yet been installed. As a result, cuttings produced during drilling for the 20 inch casing flow up over the outer wellhead housing and pile up on the guide base. Sometimes the pile of cuttings can be a problem. The extent of the cuttings may result in the operator having to extend the outer wellhead housing higher above the sea floor than desired.

Proposals have been made to return cuttings to the surface. These proposals involve various techniques to utilize a riser while drilling the 20 inch. While this would prevent the build up of cuttings around the outer wellhead housing, the proposals necessitate the use of wellhead structure that will be other than of the type conventionally employed.

SUMMARY OF THE INVENTION

In this invention, a cuttings collector is employed to collect cuttings while drilling for the 20 inch portion of the well. The cuttings collector includes a riser that fits over an exterior of the outer wellhead housing. The riser does not extend to the drilling vessel, rather it has an upper end that locates a relatively short distance above the sea floor. A cage secures to and extends around the riser. Ports are located at the upper end of the cage to communicate the interior of the riser with the annulus within the cage. Cuttings will flow up the riser and through the ports into the annulus for collection.

A guide, preferably a funnel, locates at the upper end of the riser and the cage. The guide guides the drill bit when it is lowered into the well and also guides the lower end of the 20 inch casing as it is being run from the vessel. In the preferred embodiment, the ports comprise apertures located in a section of the guide which is in the shape of a grate.

A retrieval mechanism retrieves the cage from the outer wellhead housing. Preferably the retrieval mechanism is part of the running tool for the 20 inch casing and high pressure wellhead housing. Once the casing has been cemented, the running tool retrieves the cuttings collector to the vessel. A trap door in the bottom of the cage will dump the cuttings from the cage at an appropriate place from the guide base. Preferably, a sensor automatically trips the trap door once the cuttings collector nears the surface.

Preferably the cage is made of up of a plurality of telescoping annular sections. These sections collapse and nest within one another for compact storage on the drilling vessel. The riser has an extender that will be removed from the central portion of the cage to accommodate the collapsing action.

DETAILED DESCRIPTION OF THE INVENTION

Figure 1:
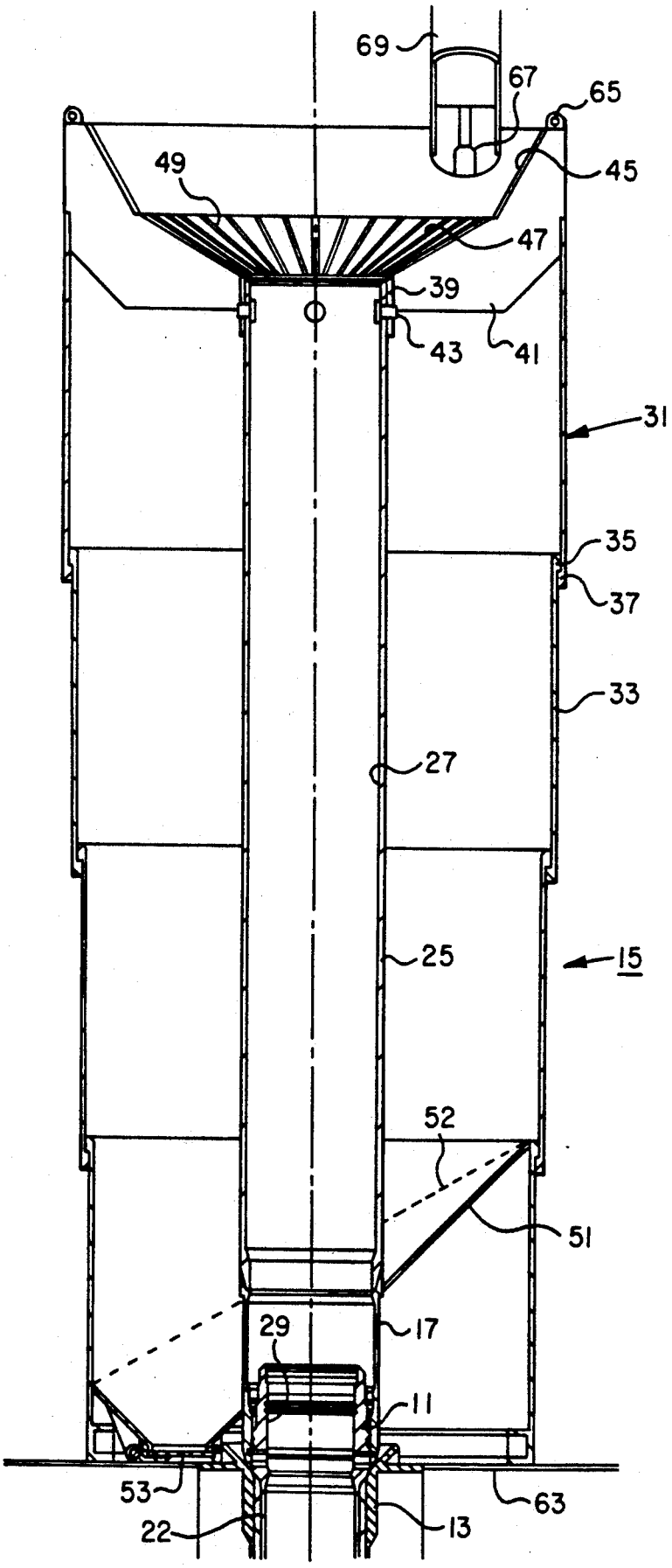
FIG. 1 is a vertical sectional view illustrating an apparatus for collecting cuttings, and shown connected to an outer wellhead housing.

Referring to FIG. 1, the subsea well will include an outer wellhead housing 11 installed on a guide base 13. Guide base 13 rests on the sea floor. A cuttings collector 15 is shown secured to the exterior of outer wellhead housing 11 and extending upward therefrom. Cuttings collector 15 includes a central conduit or riser 17 that connects to the exterior of outer wellhead housing 11.

Figure 2:
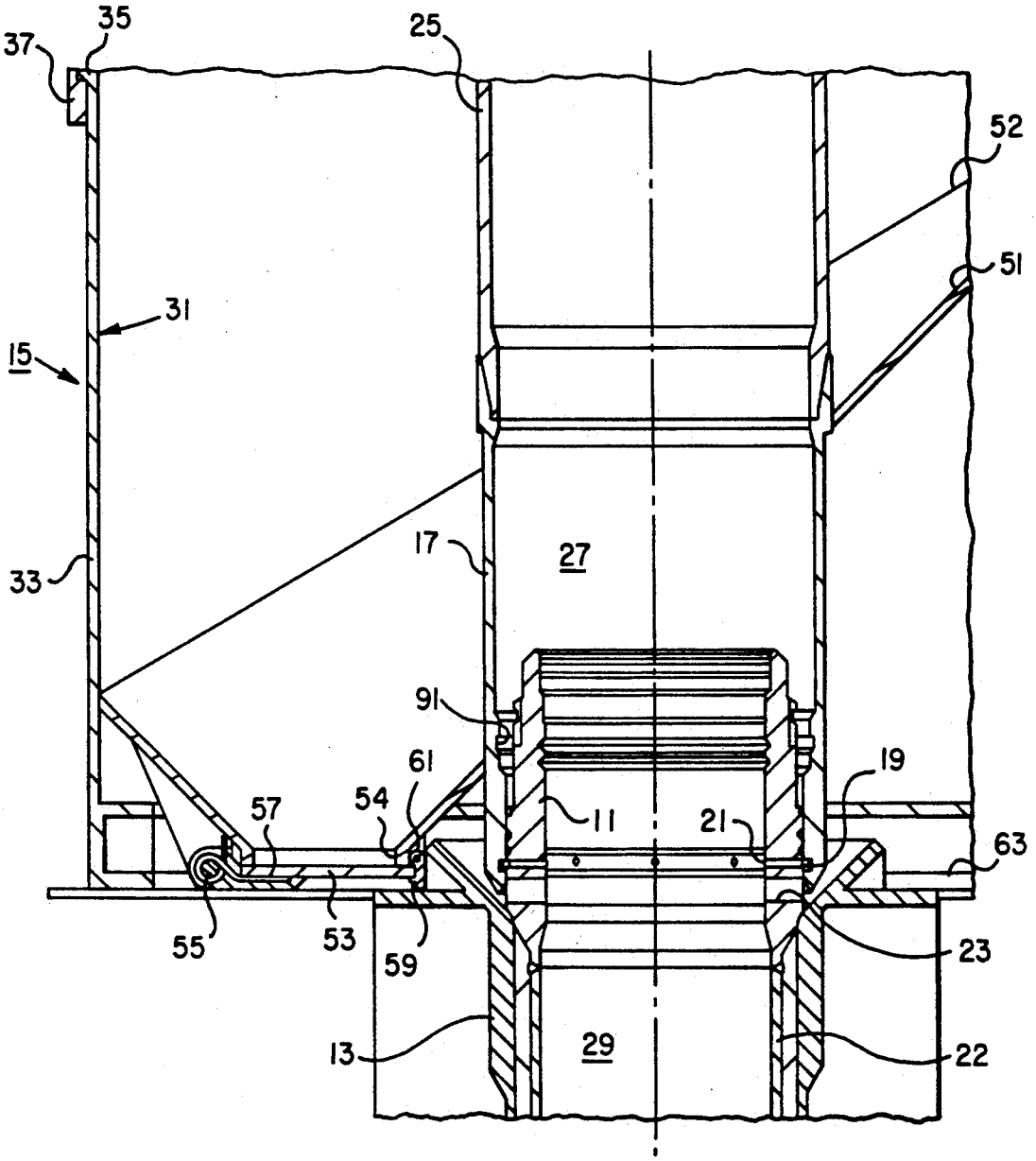
FIG. 2 is an enlarged, partial sectional view of a portion of the apparatus of FIG. 1.

Referring to FIG. 2, the connection means for connecting riser 17 to the exterior of outer wellhead housing 11 includes a split retaining ring 19. Retaining ring 19 is biased inward for engaging an annular groove formed on the exterior of outer wellhead housing 11. Part of the retrieval means for releasing retaining ring 19 includes a plurality of radially extending pins 21, shown in FIG. 2. Pins 21 have outer ends that engage the inner diameter of retaining ring 19. The inner ends of pins 21 extend into the interior of outer wellhead housing 11. When pins 21 are pushed outward, they will press retaining ring 19 radially outward to release it from the groove on the exterior of outer wellhead housing 11.

Outer wellhead housing 11 secures to a string of conductor pipe 22, which is normally 30 inches in diameter. Conductor pipe 22 will extend to a depth typically around 300 feet. Outer wellhead housing 11 has a plurality of cement return ports 23 that extend radially through the wellhead housing 11. Cement return ports 23 are located below pins 21.

Referring again to FIG. 1, riser 17 includes a riser extension 25 that extends upward from riser 17 and is secured to riser 17 by threads. The height of riser 17 is approximately six feet, and the height of riser extension 25 may be in the range of about 40 feet. The overall height of cuttings collector 15 will be about 50 feet. The diameter of bore 27 in riser 17 and riser extension 25 is the same, and is greater than the outer diameter of outer wellhead housing 11. Bore 29 of outer wellhead housing 11 will be significantly smaller than the riser bore 27.

Figure 5:
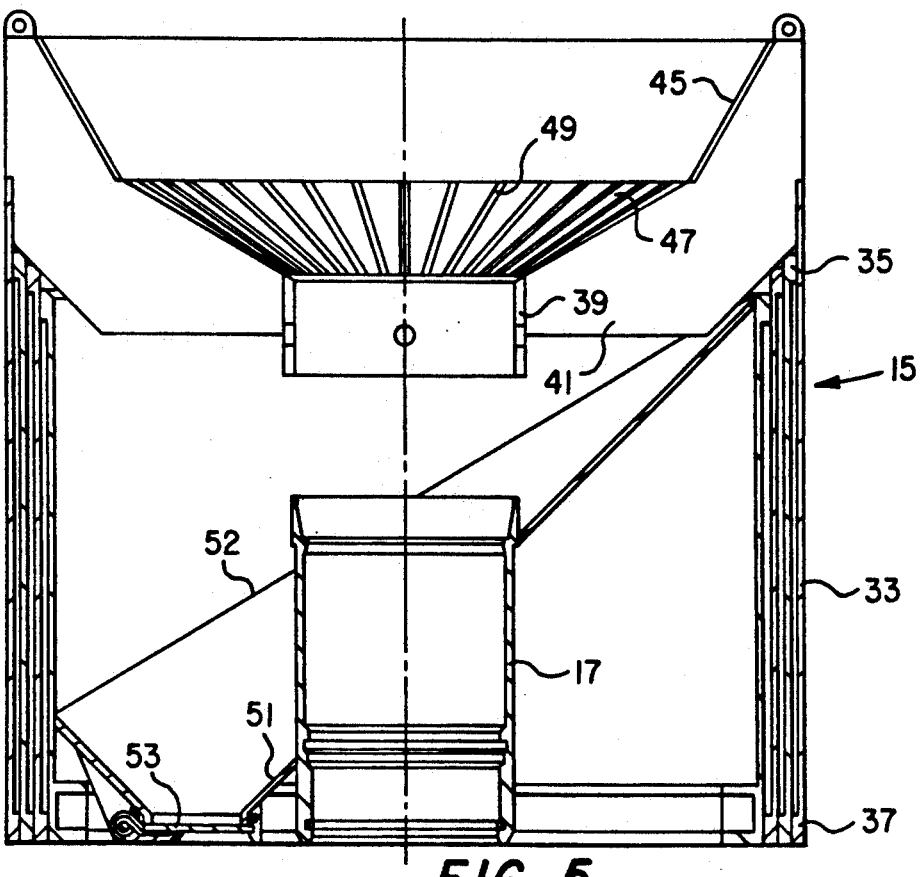
FIG. 5 is an enlarged sectional view of the apparatus of FIG. 1, shown with the riser and riser extension removed and with the cage collapsed for storage.

Cutting collector 15 includes a cage 31 that secures to riser 17 and riser extension 25. Cage 31 is preferably about 12½ feet in diameter and comprises a large annular chamber for collecting cuttings. Cage 31 may be a single large cylinder, but for storage purposes, preferably it collapses. The collapsing movement can be seen by comparing FIG. 1 with FIG. 5. In order to collapse, cage 31 is made up of a plurality of telescoping sections 33, each a solid annular ring. Each telescoping section 33 has a slightly larger diameter than the section 33 directly below. Each telescoping section 33 has an upper shoulder 35 that will slide within the inner diameter of the telescoping section 33 located directly above. Each telescoping section 33 has a lower shoulder 37 that will bear against the upper shoulder 35 when in the extended position. When collapsed as shown in FIG. 5, the sections 33 nest within one another.

The uppermost telescoping section 33 of cage 31 includes an upper sleeve 39 located concentrically therein. Sleeve 39 is slightly greater in diameter than the outer diameter of riser extension 25. A plurality of radially extending braces 41 support upper sleeve 39 concentrically in the uppermost telescoping section 33. Radially extending pins 43 secure the upper end of riser extension 25 to the upper sleeve 39. Pins 43 can be withdrawn to allow riser extension 25 to be unscrewed from riser 17 and removed for storage. FIG. 5 shows riser extension 25 withdrawn from cage 31 with pins 43 being removed.

The uppermost telescoping section 33 also has a guide means for guiding a drill bit lowered on drill pipe from the drilling vessel for drilling through the outer wellhead housing 11 and conductor pipe 22. The guide means in the preferred embodiment comprises an upward facing funnel 45. Funnel 45 extends from the upper edge of cage 31, tapering downward in a generally conical configuration to the upper sleeve 39. This places the upper end of riser extension 25 at the lower end of funnel 45 while the upper end of funnel 45 is at the upper edge of cage 31.

Funnel 45 has two sections, each having a different conical taper. The upper section of funnel 45 is a solid metal conical ring. The lower section comprises a grate 49 which is conical also, but at a lesser degree of taper than the upper section. Grate 49 comprises a plurality of bars that extend upward and outward, joining the upper section of funnel 45. The spaces or apertures 47 between the bars are large enough for cuttings to pass through them into the annular chamber of cage 31.

Figure 4:
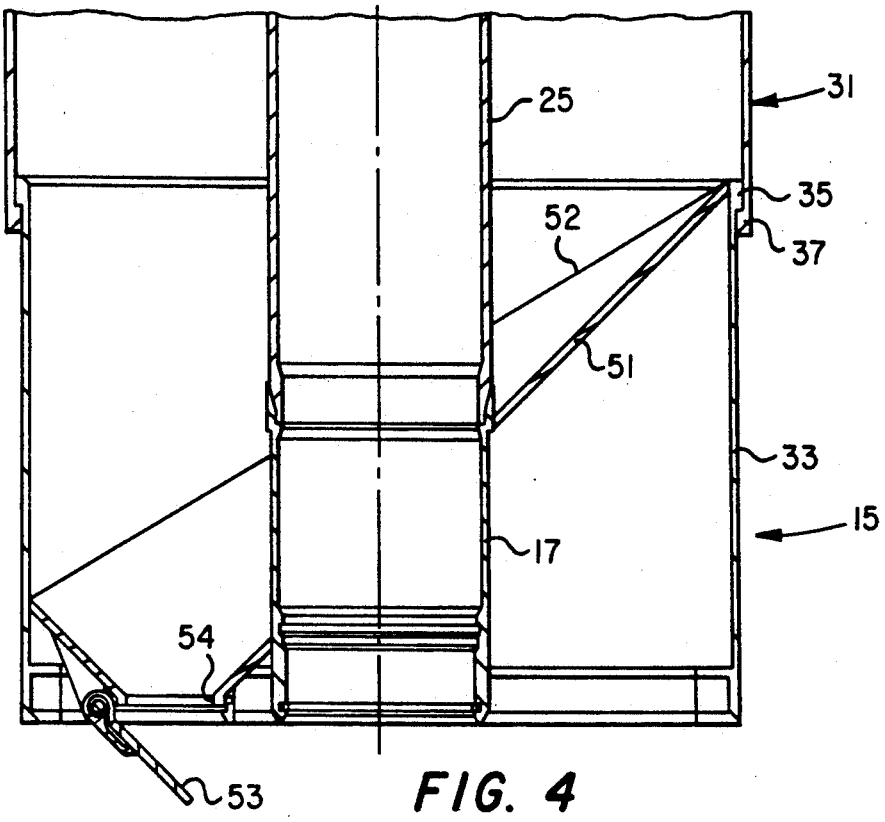
FIG. 4 is a enlarged, partial sectional view of the apparatus of FIG. 1, shown removed from the outer wellhead housing and showing the door open for dumping cuttings.

Referring also to FIG. 2, a hopper 51 is located within cage 31 in the lowermost telescoping section 33. Hopper 51 is a generally conical funnel having an upper edge 52 that inclines relative to the longitudinal axis of riser 17. The opening 54 at the bottom of hopper 51 is located adjacent the riser 17. The axis of the bottom opening 54 is offset from and parallel to the longitudinal axis of riser 17. As shown in FIG. 2, a door 53 locates at the bottom opening 54 of hopper 51. Door 53 moves between an open and closed position by means of a hinge 55. FIG. 2 shows door 53 closed, while FIG. 4 shows door 53 open for dumping collected cuttings. A spring 57 urges door 53 to the closed position.

A latch 59 is located opposite hinge 55. Latch 59 will hold door 53 in the closed position. In the preferred embodiment, latch 59 has a depth sensor 61 connected to it. Depth sensor 61 is a pressure sensitive device that will cause latch 59 to pivot to a release position shown in FIG. 4 when the depth in the sea is within a certain range, for example, less than 100 feet. Once the hydrostatic pressure drops below a selected minimum, indicating that the depth is less than the selected minimum, sensor 61 will actuate latch 59 to the open position shown in FIG. 4. While latch 59 is closed, it will prevent the weight of cuttings On door 53 from overcoming the bias of spring 57 and causing door 53 to move to the open position. Latch 59 will release door 53 to allow the cuttings weight to push door 53 to the open position only when the depth is less than the preselected amount. Sensors which will actuate upon reaching selected subsea depths are commercially available.

Referring again to FIG. 1, cage 31 is a solid member having no apertures other than apertures 47 and opening 54. Bottom 63 will rest on a part of the template or guide base 13. Lugs 65 locate on the upper end of cage 31 for handling for storage. FIG. 1 shows a cement shoe 67 located on the lower end of a first string of casing 69 being lowered into cuttings collector 15 from a floating vessel (not shown). Funnel 45 will guide the cement shoe 67 into the riser extension 27.

Figure 3:
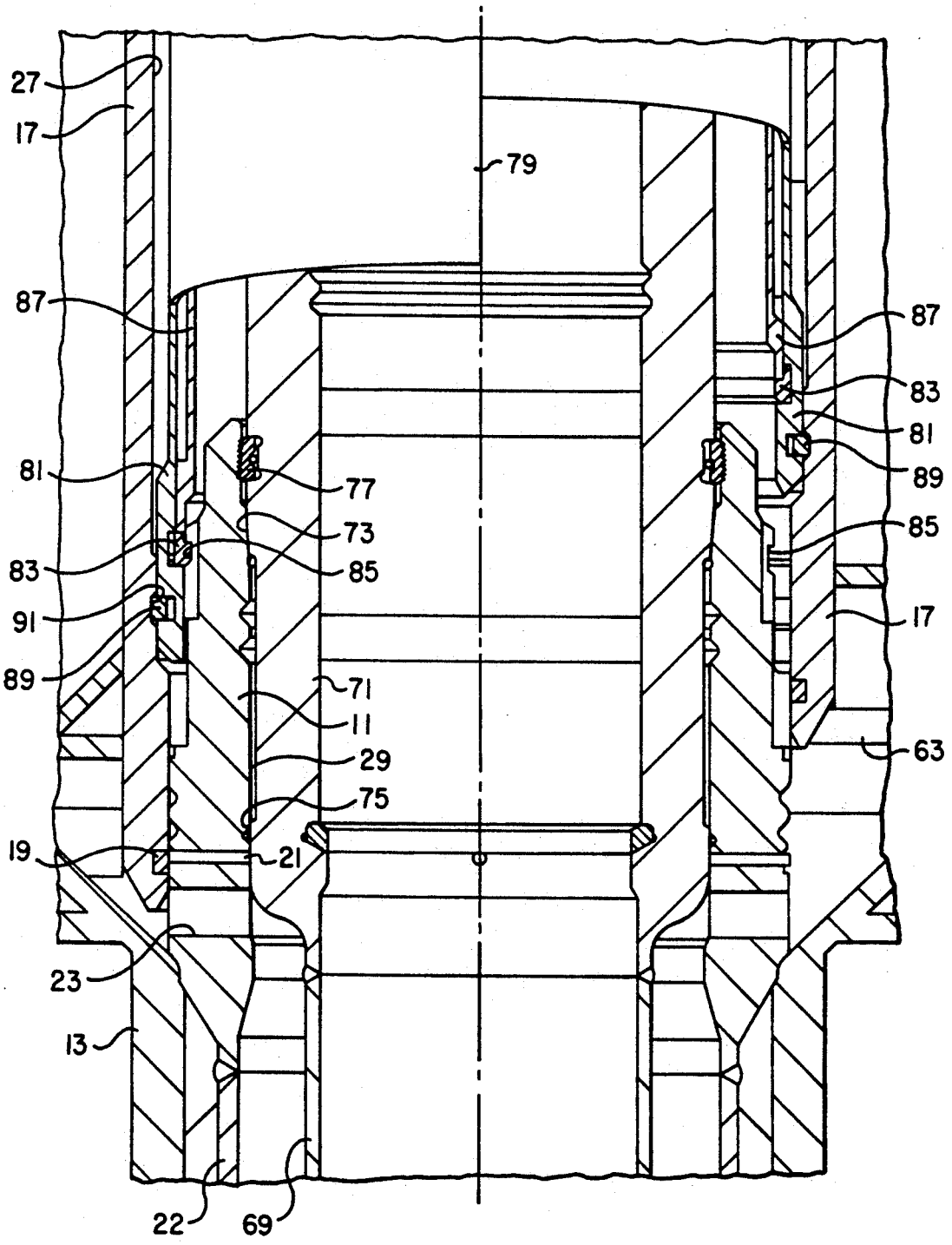
FIG. 3 is a further enlarged partial sectional view of a portion of the apparatus of FIG. 1, and showing an inner wellhead housing installed in the outer wellhead housing, with the left side of FIG. 3 showing the running position and the right side showing the cuttings collector being released from the outer wellhead housing for removal.

FIG. 3 shows the casing 69 installed in the well. A high pressure inner wellhead housing 71 secures to the upper end of casing 69. Inner wellhead housing 71 preferably has two axially spaced apart tapers 73, 75, which fit tightly within mating tapers in the bore 29 of outer wellhead housing 11. Taper 75 enqaqes the inner ends of pins 21 to press them outward as shown in FIG. 3. Inner wellhead housing 71 has a latch 77 that latches into grooves formed in bore 29 of outer wellhead housing 11.

A running tool 79 lowers inner wellhead housing 71 and at the same time serves to retrieve cuttings collector 15. Running tool 79 is a type as shown in U.S. Pat. No. 5,188,180 Jennings et al. Running tool 79 forces inner wellhead housing 71 tightly within outer wellhead housing by hydraulic action. Running tool 79 has an inner member (not shown) which releasably engages grooves in the bore of inner wellhead housing 71. Running tool 79 has an outer sleeve 81 that locates on the exterior of outer wellhead housing 11. Outer sleeve 81 has an engaging ring 83 carried in an internal groove in outer sleeve 81. Engaging ring 83 is a split ring and is biased inward for snapping into a groove 85 formed on the exterior of outer wellhead housing 11.

Running tool 79 has a cam sleeve 87 located in the interior of outer sleeve 81. Cam sleeve 87 has a lower end that will push engaging ring 83 outward from the outer wellhead housing groove 85 when cam sleeve 87 is pushed downward. This releases running tool 79 from outer wellhead housing 11.

Running tool 79 operates as shown in the above mentioned patent application, and is modified from that shown in the patent application to include another engaging ring 89. Engaging ring 89 is carried on the exterior of outer sleeve 81. Engaging ring 89 is also a split ring, however it is biased to snap outward into a groove 91. Groove 91 locates in the riser bore 27. This engagement will connect the running tool 79 to the riser 17.

In operation, initially a guide base 13 will be located on the sea floor. The operator will drill or jet a first portion of the well for receiving conductor pipe 22. The operator connects outer wellhead housing 11 to conductor pipe 22. The operator will assemble cuttings collector 15 from a storage position shown in FIG. 5 to an extended position as shown in FIG. 1. The operator assembles the cuttings collector 15 below the drilling vessel and above the surface of the water. To assemble, the operator secures riser extension 25 to riser 17 by use of the threads connecting the riser extension 25 to the riser 17. The operator installs pins 43 to connect the riser extension 25 to the sleeve 39. This will hold the cuttings collector 15 in the extended position shown in FIG. 1.

The operator uses a conventional running tool (not shown) which engages grooves in the bore 29 of outer wellhead housing 11 to lower the entire assembly into the well, along with conductor pipe 22 and cuttings collector 15. Initially, at the surface, latch 59 will be in a released position, but door 53 will be shut because of spring 57. Once the cuttings collector passes the preselected depth, sensor 61 will close latch 59, preventing door 53 from opening. The outer wellhead housing 11 and cuttings collector 15 will land on guide base 13. After landing, the operator will cement the conductor pipe 22 in place in a conventional manner.

The cuttings collector 15 will now be positioned subsea at a depth which would likely be more than 1,000 feet below the surface of the water. The operator then lowers a drill bit (not shown) on a string of drill pipe. The operator will stab into funnel 45, which will guide the drill bit into riser 27. The drill bit will pass through bore 29 of outer wellhead housing 11 and through conductor pipe 22. The operator will drill the well to the second depth.

While drilling, cuttings from the earth formations will flow up the well, conductor pipe 22, riser 17, riser extension 25, and through the openings 47 in grate 49. The cuttings will fall into the annulus chamber of cage 31 and collect in the hopper 51. Sea water in cage 31 will be displaced out and flow over the top of cage 31. The cage 31 will continue to fill with cuttings during drilling. Cage 31 has sufficient capacity to receive all of the cuttings produced during the drilling of the well for the first string of casing 69. The operator then retrieves the drill bit to the surface, which passes freely upward through the riser 17 and riser extension 25. Cage 31 remains secured to outer wellhead housing 11 with the cuttings contained therein.

The operator then connects cement shoe 67 to a lower end of the string of casing 69. The operator secures the sections of the casing 69 together and lowers the string into the well. When the desired length of casing 69 has been reached, the operator will secure inner wellhead housing 71 (FIG. 3) to the upper end of casing 69. The operator secures running tool 79 to inner wellhead housing 71 in a manner as shown and described in the above mentioned patent application. The operator lowers the entire assembly into the well on conduit such as drill pipe. FIG. 1 shows the cement shoe 67 stabbing into funnel 45. Funnel 45 Will guide the cement shoe 67 into the riser bore 27.

Referring to FIG. 3, eventually the inner wellhead housing 71 will pass through the riser bore 27 and land in the outer wellhead housing bore 29. Tapers 73, 75, will engage the mating tapers in the outer wellhead housing bore 29. The lower taper 75 will simultaneously push the pins 21 outward. This movement causes the cuttings collector retaining ring 19 to move radially outward from engagement with the mating groove on the exterior of outer wellhead housing 11.

The operator actuates running tool 79 to move the outer sleeve 81 downward after inner wellhead housing 71 has initially landed in outer wellhead housing 11. Engaging ring 83 will engage groove 85 on the exterior of outer wellhead housing 11. At the same time, engaging ring 89 will engage groove 91 in the interior of riser 17.

The operator continues to actuate running tool 79 to push downward On inner wellhead housing 71 with great force, with the reaction being handled through the engaging ring 83. This seats the inner wellhead housing 71 in outer wellhead housing 11. Latch 77 then will ratchet in a downward movement and lock the inner wellhead housing 71 in its lowermost seated position. The operator will then cement the casing 69, pumping cement down the casing 69 to return up the annulus surrounding casing 69. The cement returns will flow through the cement return ports 23.

After the cement has set, the operator will release the running tool 79 from the outer wellhead housing 11 and inner wellhead housing 71. The operation for releasing from the inner wellhead housing 71 is explained in the above mentioned patent application. The operator Will release the running tool 79 from the outer wellhead housing 11 by causing cam sleeve 87 to move downward. Cam sleeve 87 will push engaging ring 83 outward, freeing it from groove 85. The operator then picks up on the drill pipe to lift running tool 79. Engaging ring 89 will cause this movement to also lift riser 17 and the entire cuttings collector 15. Pins 21 will keep retaining ring 19 out of the mating groove on outer wellhead housing 11 to allow this releasing movement. The right side of FIG. 3 shows the cuttings collector 15 lifted a short distance.

The operator then pulls the drill pipe, running tool 79 and cuttings collector 15 upward to the vessel. Once the selected dumping depth has been reached, the sensor 61 (FIG. 2) will actuate to move latch 59 to the release position, releasing door 53. The weight of the cuttings in cage 31 will be sufficient to overcome the bias of spring 57 and push door 53 to the open position shown in FIG. 4. Cuttings will then fall from cage 31, down the hopper 51 and out opening 54 in the lower end of hopper 51. This dumping movement will occur near the surface, and currents and wave motion will cause the cuttings to gradually drift back to the sea floor at a location remote from the subsea well.

The operator then pulls the cuttings collector 15 up to the moon pool (not shown) area of the drilling vessel. The operator will remove pins 43 and unscrew riser extension 25 from riser 17. Using lugs 65, the operator will collapse the sections 33 to the position shown in FIG. 5. The operator will then store the collapsed cutting collector 15 on the drilling vessel until it is needed for the next well.

The invention has significant advantages. The cuttings collector allows an operator to conveniently collect cuttings while drilling for the first string of casing extending through the conductor pipe. The collection of the cuttings avoids the pile up of cuttings around the outer wellhead housing on the guide base. The collection of cuttings is handled without making any changes to the subsea well assembly, other than providing an additional groove and release pins in the outer wellhead housing. The cuttings collector also serves as an upward facing funnel for guiding the drill bit and casing. The cuttings collector is retrieved during the same trip in which the first string of casing is installed. The cutting collector collapses for convenient storage.

While the invention has been shown in only one of its forms, it should be apparent to those skilled in the art that it is not so limited but is susceptible to various changes without departing from the scope of the invention.

I claim:

1. A cuttings collector apparatus for use with a drilling vessel for drilling a subsea well having an outer wellhead housing at a subsea floor, the outer wellhead housing having an axial bore and being secured to a string of conductor pipe extending into the well, comprising:

a riser having an inner diameter at least equal to a diameter of the bore of the outer wellhead housing to allow a drill bit to pass freely through the riser into and out of the outer wellhead housing;

riser connection means for connecting the lower end of the riser to the outer wellhead housing for supporting the riser on the outer wellhead housing, the riser having an upper end that locates below the sea surface;

a cage secured to and extending around the riser;

port means between the riser and the cage for causing cuttings flowing up the riser while drilling with the drill bit to pass into the cage for collection;

guide means at the upper end of the riser for guiding the drill bit into the riser as it is lowered on drill pipe from the vessel; and retrieval means for releasing the riser connection means to retrieve the riser and the cage from the outer wellhead housing after the well has been drilled to a selected depth, allowing disposal of the cuttings away from the outer wellhead housing.

2. The apparatus according to claim 1 wherein the riser connection means connects the lower end of the riser to the exterior of the outer wellhead housing.

3. The apparatus according to claim 1 wherein the cage has an upper end that locates above the upper end of the riser.

4. The apparatus according to claim 1 wherein the guide means comprises:

a funnel extending from an upper end of the cage to an upper end of the riser.

5. The apparatus according to claim 1 wherein the guide means comprises:

an upward facing funnel extending from an upper end of the cage downward to the upper end of the riser; and wherein the port means comprises:

a plurality of apertures through the funnel.

6. The apparatus according to claim 1 wherein the cage comprises:

a plurality of nestable annular sections telescopingly secured together, the sections collapsing and nesting for storage while the cage is not in use.

7. The apparatus according to claim 1 further comprising:

a door mounted to the cage adjacent the lower end of the riser; and opening means for selectively releasing the door to open to allow the cuttings to be dumped from the cage.

8. The apparatus according to claim 1 further comprising:

a hopper located at a lower end of the cage and having a bottom located adjacent the lower end of the riser;

a door mounted to the bottom of the hopper; and opening means for selectively releasing the door to open allow the cuttings to be dumped from the cage.

9. The apparatus according to claim 1 wherein the retrieval means comprises:

running tool means for engaging and running an inner wellhead housing through the riser for location inside the outer wellhead housing, the inner wellhead housing being secured to a first string of casing, the running tool means having release means for engaging the riser and releasing the connection means.

10. A cuttings collector apparatus for use with a drilling vessel for drilling a subsea well having an outer wellhead housing at a subsea floor, the outer wellhead housing having an axial bore and being secured to a string of conductor pipe extending into the well, comprising:

a riser having an upper end and a lower end;

riser connection means for connecting the lower end of the riser to the outer wellhead housing;

a cage secured to and extending around the riser, the cage having a lower end with an opening;

port means between the riser and the cage for causing cuttings flowing up the riser while drilling to pass into the cage for collection;

retrieval means for releasing the riser connection means to retrieve the riser and the cage from the outer wellhead housing after the well has been drilled to a selected depth;

a door mounted to the cage at the opening and movable between an open position, exposing the opening, and a closed position, blocking the opening; and opening means for selectively causing the door to move to the open position to allow the cuttings to be dumped from the cage after the cage has been removed from the outer wellhead housing, allowing disposal of the cuttings remote from the outer wellhead housing.

11. The apparatus according to claim 10 further comprising:

a hopper located at the lower end of the cage, the opening of the cage being located at the bottom of the hopper.

12. The apparatus according to claim 10, further comprising:

guide means at the upper end of the riser and at an upper end of the cage for guiding a drill bit into the riser as it is lowered on drill pipe from the vessel.

13. The apparatus according to claim 10 wherein the riser connection means connects the lower end of the riser to the exterior of the outer wellhead housing; and wherein the riser has an inner diameter at least equal to a diameter of the bore of the outer wellhead housing, allowing a drill bit to pass freely into and out of the riser.

14. The apparatus according to claim 10 wherein the opening means has sensor means operable in response to hydrostatic sea pressure for automatically moving the door to the open position when the apparatus reaches a selected depth during retrieval.

15. The apparatus according to claim 10 further comprising:

an upward facing funnel extending from an upper end of the cage downward to the upper end of the riser for guiding a drill bit into the riser as the drill bit is lowered from the drilling vessel.

16. The apparatus according to claim 10 further comprising:

an upward facing funnel extending from an upper end of the cage downward to the upper end of the riser for guiding a drill bit into the riser as the drill bit is lowered from the drilling vessel; and wherein the port means comprises:

a plurality of apertures through the funnel.

17. The apparatus according to claim 10 wherein the cage comprises:

a plurality of nestable annular sections telescopingly secured together, the sections collapsing and nesting for storage while the cage is not in use.

18. The apparatus according to claim 10 wherein the retrieval means comprises:

running tool means for engaging and running an inner wellhead housing through the riser for location inside the outer wellhead housing, the inner wellhead housing being secured to a first string of casing, the running tool means having release means for engaging the riser and releasing the connection means.

19. A cuttings collector apparatus for use with a drilling vessel for drilling a subsea well having an outer wellhead housing at a subsea floor, the outer wellhead housing having an axial bore and being secured to a string of conductor pipe extending into the well, comprising in combination:

a riser having an upper end and lower end;

riser connection means for connecting the lower end of the riser to the outer wellhead housing for supporting the riser on the outer wellhead housing with the upper end of the riser being located subsea;

a cage secured to and extending around the riser, having an upper end located above the upper end of the riser, and having a lower end;

an upward facing funnel extending from the upper end of the cage downward to the upper end of the riser for guiding a drill bit being lowered from the drilling vessel into the riser for drilling to a selected depth;

a plurality of apertures in the funnel for allowing cuttings flowing up the riser while drilling with the drill bit to pass into the cage for collection; and retrieval means for releasing the riser connection means to retrieve the riser and the cage from the outer wellhead housing after the well has been drilled to the selected depth, allowing disposal of the cuttings away from the outer wellhead housing.

20. The apparatus according to claim 19 wherein the cage comprises:

a plurality of nestable sections telescopingly secured together, the sections collapsing and nesting for storage while the cage is not in use.

21. The apparatus according to claim 19 further comprising:

an opening at the lower end of the cage;

a door mounted to the cage at the opening of the cage and adjacent the lower end of the riser for movement between an open position, exposing the opening, and a closed position, blocking the opening; and opening means for selectively causing the door to move to the open position to allow the cuttings to be dumped from the cage.

22. The apparatus according to claim 19 further comprising:

a hopper located at the lower end of the cage and having a bottom;

a door mounted to the bottom of the hopper; and opening means for selectively allowing the door to open to allow the cuttings to be dumped from the cage.

23. The apparatus according to claim 19 wherein the retrieval means comprises:

running tool means for engaging and running an inner wellhead housing through the riser for location inside the outer wellhead housing, the inner wellhead housing being secured to a first string of casing, the running tool means having release means for engaging the riser and releasing the connection means.

24. A cuttings collector apparatus for use with a drilling vessel for drilling a subsea well having an outer wellhead housing at a subsea floor, the outer wellhead housing having an axial bore and being secured to a string of conductor pipe extending into the well, comprising in combination:

a riser having an upper end and a lower end;

riser connection means for connecting the lower end of the riser to the outer wellhead housing;

a cage secured to and extending around the riser;

port means between the riser and the cage for causing cuttings flowing up the riser while drilling to pass into the cage for collection;

retrieval means for releasing the riser connection means to retrieve the riser and the cage from the outer wellhead housing after the well has been drilled to a selected depth; and the cage comprising a plurality of nestable sections telescopingly secured together, the sections collapsing and nesting for storage while the cage is not in use.

25. The apparatus according to claim 24 wherein the cage has an upper end that locates above the upper end of the riser.

26. The apparatus according to claim 24 further comprising guide means located at the upper end of the riser for guiding a drill bit lowered from the vessel into the riser, the guide means comprising:

a funnel extending from an upper end of the cage downward to the upper end of the riser.

27. The apparatus according to claim 24 further comprising:

a funnel extending from an upper end of the cage downward to the upper end of the riser to guide a drill bit being lowered from the vessel; and wherein the port means comprises:

a plurality of apertures through the funnel.

28. The apparatus according to claim 24 further comprising:

a door mounted to a lower end of the cage; and opening means for selectively causing the door to open to allow the cuttings to be dumped from the cage.

29. The apparatus according to claim 24 further comprising:

an inclined hopper secured to a lowermost of the nestable sections of the cage and having a bottom located adjacent the lower end of the riser;

a door mounted to the bottom of the hopper; and opening means for selectively causing the door to open to allow the cuttings to be dumped from the cage.

30. The apparatus according to claim 24 wherein the retrieval means comprises:

running tool means for engaging and running an inner wellhead housing through the riser for location inside the outer wellhead housing, the inner wellhead housing being secured to a first string of casing, the running tool means having release means for engaging the riser and releasing the connection means.

31. A cuttings collector apparatus for use with a drilling vessel for drilling a subsea well having an outer wellhead housing at a subsea floor, the outer wellhead housing having an axial bore and being secured to a string of conductor pipe extending into the well, the subsea well also including an inner wellhead housing which secures to a first string of casing and lands within the outer wellhead housing, the apparatus comprising in combination:

a riser having an inner diameter at least equal to a diameter of the bore of the outer wellhead housing to allow a drill bit to pass freely through the riser into and out of the outer wellhead housing;

a cage secured to and extending around the riser;

riser connection means for connecting the lower end of the riser to the exterior of the outer wellhead housing prior to installing the conductor pipe in the well, to allow the riser and cage to be lowered into the sea from the drilling vessel simultaneously with the outer wellhead housing and conductor pipe, the riser having an upper end that is submerged when the conductor pipe is installed in the well;

guide means at the upper end of the riser for guiding the drill bit into the riser as it is lowered on drill pipe from the vessel;

port means between the riser and the cage for causing cuttings flowing up the riser while drilling with the drill bit to pass into the cage for collection;

a release profile located in the interior of the riser;

running tool means for releasably engaging the inner wellhead housing and for lowering the inner wellhead housing into the outer wellhead housing after the well has been drilled to a selected depth; and the running tool means having releasing means for engaging the release profile of the riser and for pulling the riser and cage upward from the outer wellhead housing after the inner wellhead housing has landed, to retrieve the riser and the cage from the outer wellhead housing after the well has been drilled to the selected depth, allowing disposal of the cuttings remote from the outer wellhead housing.

32. The apparatus according to claim 31 wherein the guide means comprises:

an upward facing funnel extending from an upper end of the cage to an upper end of the riser.

33. The apparatus according to claim 31 wherein the guide means comprises:

an upward facing funnel extending from an upper end of the cage downward to the upper end of the riser; and wherein the port means comprises:

a plurality of apertures through the funnel.

34. The apparatus according to claim 31 wherein the cage comprises:

a plurality of nestable sections telescopingly secured together, the sections collapsing and nesting for storage while the cage is not in use.

35. The apparatus according to claim 31 further comprising:

a door mounted to the cage adjacent the lower end of 7 the riser; and opening means for selectively causing the door to open to allow the cuttings to be dumped from the cage.

36. The apparatus according to claim 31 further comprising:

an inclined hopper located within the cage and having a bottom located adjacent the lower end of the riser;

a door mounted to the bottom of the hopper; and opening means for selectively causing the door to open to allow the cuttings to be dumped from the cage.

37. A method of drilling a subsea well with a drilling vessel, comprising:

providing a riser with a surrounding cage, providing ports at upper ends of the riser and cage which communicate the interior of the riser with the interior of the cage, and providing an upward facing guide at the upper ends of the riser and cage;

connecting a lower end of the riser to an outer wellhead housing;

installing the outer wellhead housing on a subsea floor with a string of conductor pipe extending into the well;

lowering a drill bit from the vessel into the guide, through the riser and the conductor pipe; then drilling the well to a selected depth, causing cuttings from the drilling to flow up the riser and through the ports and into the cage for collection; then retrieving the drill bit from the well and from the riser while the riser and cage remain connected to the outer wellhead housing; then removing the riser and cage from the outer wellhead housing, and dumping the cuttings from the cage at a place remote from the outer wellhead housing.

38. The method according to claim 37 wherein the step of connecting a lower end of the riser to the outer wellhead housing occurs prior to installing the outer wellhead housing on a subsea floor.

39. The method according to claim 37 wherein prior to removing the riser and cage from the outer wellhead housing and after retrieving the drill bit from the well, the following steps are performed:

connecting a string of casing to the lower end of an inner wellhead housing; then lowering the casing and inner wellhead housing into the guide and through the riser, landing the inner wellhead housing in the outer wellhead housing, and cementing the string of casing in the well.

40. The method according to claim 37 wherein the step of dumping the cuttings from the cage is performed by opening a door mounted to a bottom of the cage.

* * * * *

UNITED STATES PATENT AND TRADEMARK OFFICE

CERTIFICATE OF CORRECTION

PATENT NO. : 5,284,213

DATED : February 8, 1994

INVENTOR(S) : Philippe C. Nobileau

It is certified that error appears in the above-indentified patent and that said Letters Patent is hereby corrected as shown below:

At column 4, line 20, "On" should be --on--;

At column 6, line 18, "On" should be --on--;

At column 12, line 15, "7" should be deleted.

Signed and Sealed this

Sixteenth Day of August, 1994

Bruce Lehman

*Attest:*

BRUCE LEHMAN

*Attesting Officer*

*Commissioner of Patents and Trademarks*